United States Patent [19]

Schwarz

[11] 4,034,587

[45] July 12, 1977

[54] CONCRETE REINFORCEMENT RODS

[76] Inventor: Wilhelm Schwarz, Schlusselfeld, Germany

[21] Appl. No.: 587,692

[22] Filed: June 17, 1975

Related U.S. Application Data

[60] Division of Ser. No. 385,252, Aug. 3, 1973, abandoned, which is a continuation of Ser. No. 160,360, Aug. 7, 1971, abandoned.

[30] Foreign Application Priority Data

July 8, 1970 Germany ..... 2033759
Sept. 29, 1970 Germany ..... 2047708

[51] Int. Cl.[2] ..... B21H 8/02
[52] U.S. Cl. ..... 72/194; 72/198
[58] Field of Search ..... 72/194, 195, 198, 196; 52/737, 738, 739, 734, 735

[56] References Cited

U.S. PATENT DOCUMENTS

| | | | |
|---|---|---|---|
| 815,617 | 3/1906 | Mueser | 52/737 |
| 891,234 | 6/1908 | Crane | 52/734 |
| 911,062 | 2/1909 | McMullin | 52/734 |
| 1,154,664 | 9/1915 | Slick | 72/198 |
| 1,202,335 | 10/1916 | Varney | 52/734 |
| 1,431,443 | 10/1922 | Cowles | 72/194 |
| 2,016,128 | 10/1935 | White | 52/738 |
| 2,552,364 | 5/1951 | Bradbury | 72/198 |

FOREIGN PATENT DOCUMENTS

| | | | |
|---|---|---|---|
| 47-25976 | 7/1972 | Japan | 72/198 |
| 21,331 | 1966 | Japan | 72/199 |

*Primary Examiner*—Lowell A. Larson
*Attorney, Agent, or Firm*—Toren, McGeady and Stanger

[57] ABSTRACT

The invention is concerned with a reinforcing rod for concrete and a rolling tool for making the rod. The rod has several cold rolled serpentine shaped ribs distributed around its periphery and extending generally in the axial direction.

8 Claims, 12 Drawing Figures

FIG. 1
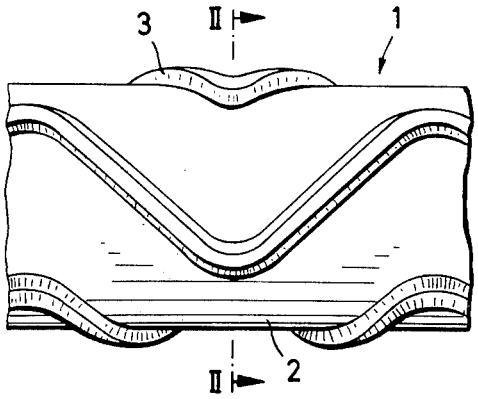
FIG. 2
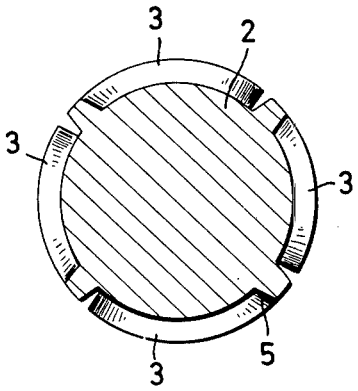
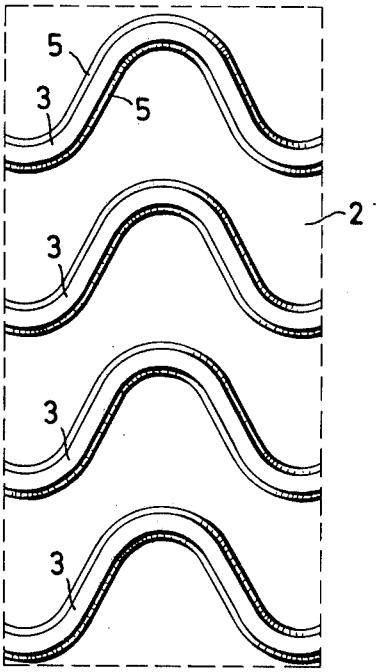
FIG. 3
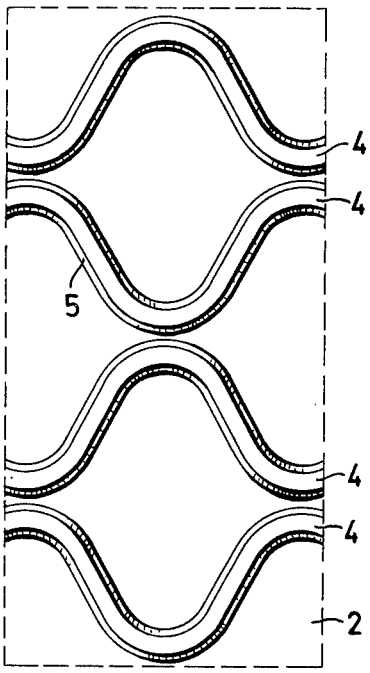
FIG. 4

FIG. 10
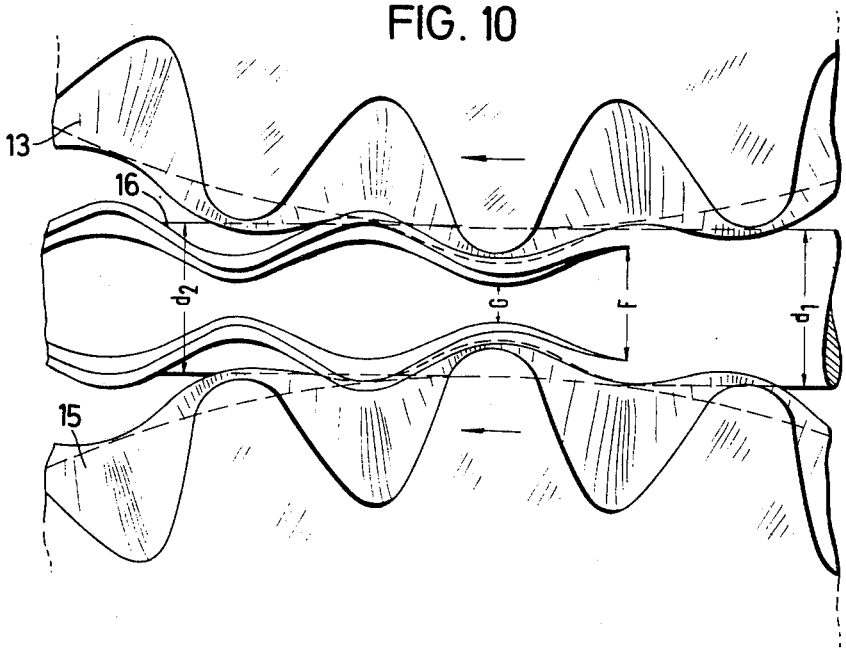
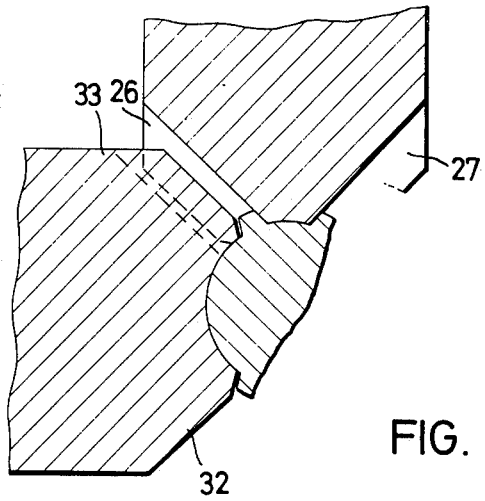
FIG. 12

CONCRETE REINFORCEMENT RODS

This is a Division of application Ser. No. 385,252 filed Aug. 3, 1973, which, in turn was a Continuation of Application Ser. No. 160,360 filed Aug. 7, 1971, both abandoned.

The invention relates to a reinforcing rod for concrete, with cold-rolled ribs, intended primarily for use in the manufacture of reinforcing mesh for reinforced concrete structures.

In reinforced concrete construction the strength requirements are constantly increasing. Consequently repeated attempts are being made to improve the bond between the concrete and the reinforcing steel. This bond can however be improved only by modifying the surface geometry of the steel reinforcement. It is known to use reinforcing rods which have ribs distributed around the periphery, the ribs running at an angle relative to the axis of the rod. The known rods of this kind are manufactured by hot rolling. By this method it is very easy to produce the ribs, the steel being ductile at the temperatures used.

On the other hand in the manufacture of welded mesh reinforcement the ribs cannot be produced on the rods in the hot state, because the mesh is made from rod which has been drawn so as to show the properties of a cold worked material. Ribs previously produced by hot rolling disappear during the cold drawing.

In this cold drawn material the ribs can be produced only by cold deformation, after the rod has been cold drawn, or during the cold drawing process. The rod cannot of course be heated again, to make it easier to produce the ribs, because this would change the properties of the cold drawn material. In producing ribs on the cold drawn material difficulties have arisen because attempts have been made to produce ribs which have the same shapes as the known hot rolled ribs. The criterion used is the "relative rib surface", which is taken to be a measure of the adhesion between the steel and the concrete. The relative rib surface is the sum of the surfaces of the ribs distributed around the periphery of the rod, divided by the approximately circular cross section of the rod core, multiplied by the distance between ribs.

A cold-deformed rod for reinforcing concrete is known from the German patent specification No. (Auslegeschrift) 1,609,605, which has three flattened areas at 120° around the periphery. Projecting from each flattened area there is a row of crescent shaped diagonal ribs. The two ends of each rib merge into the surface of the rod. Each rib slopes at an angle between 45° and 60° relative to the rod axis. The ribs are distributed equally spaced along the length of the rod, the rows of ribs running in opposite directions so that the two rows of ribs form V angles with each other. The purpose of this is to prevent any screw action, which would tend to allow the rod to screw out of the concrete when put under tension. However this arrangement has the disadvantage that each rib can act as a thin wedge, tending to force the concrete away.

In the cold rolling of these ribs a high rolling pressure is necessary so as to satisfy specifications in regard to the relative rib surface. The high rolling pressure used can result in excessive cold working, making the steel brittle. The sharp changes in the cross section of the rod, between the core and the ribs, produce undesired crystalline changes and give rise to considerable notch stresses, particularly at the locations where ribs come together forming the V angle. At these locations the steel can suffer brittle rupture. Rods of this kind have the further disadvantage that the cross section is not uniform over the length of the rod, due to the different directions of the ribs. A result is that the stress is unevenly applied and the rod has a low dynamic strength. Dynamic strength, which is measured by an oscillation fatigue test, is an important criterion in the case of reinforcing rods and mesh which are subjected in operation to dynamic loads. A further disadvantage of rods of this kind, in addition to the brittle locations along the length of the rod, due to varying cross section and to a disturbed crystaline structure in the regions of the ribs, is that the rolling tools used in the cold rolling wear out rapidly, due to the high rolling pressure. The tools themselves are costly, due to the high rolling pressures, and the hard metal inserts easily break out of the tools. All this results in high manufacturing costs.

The disadvantages mentioned above give these known rods unfavourable properties, particularly when they are dynamically loaded, and consequently even comparatively small surface faults, for example due to imperfect roll surfaces, can easily result in rod fracture. These known rods, whose ribs have shapes taken over from the hot-rolled ribbed rods, have the further disadvantage that they suffer from severe abrasion when passing through a straightening machine. In the case of the hot-deformed rod this does not matter, because these rods are usually manufactured in the form of straight lengths of rod, and do not pass through a straightening machine. Furthermore these hot-deformed rods have large cross sections and comparatively large ribs, which do not suffer so greatly from abrasion. In manufacturing wire mesh, on the other hand, the wire or rod is stored coiled on a drum and has to be straightened, by passing through a straightening machine, before being used in manufacturing the mesh. The straightening machine has a tool which rotates at high speed around the rod to straighten it. Any projections standing out from the core of the rod are therefore particularly exposed to abrasive action.

The object of the present invention is to provide a reinforcing rod which is free from the disadvantages of the known rods, and in accordance with the invention the rod has several cold rolled serpentine ribs distributed around its periphery and extending generally in the axial direction of the rod.

The reinforcing rod according to the invention thus has, in contrast to the large number of ribs of the known ribbed reinforcing rods, only a few ribs extending continuously, generally in the axial direction of the rod. Consequently the rod has a similar cross section all the way along its length, giving a perfectly even stress distribution. When the rod is embedded in concrete, the projecting ribs enclose portions of the concrete particularly effectively, producing an almost ideal anchoring effect.

The known reinforcing rods, due to their numerous individual ribs, have a large number of locations where the ribs begin and end. These are weak points in the rod. The beginnings and ends of the ribs form wedge surfaces which, as prescribed by the official specifications, have to be comparatively flat wedges, that is to say wedges with little slope. Ribs of this shape have a considerable wedge action tending to force the concrete away. In contrast to this, in the reinforcing rod according to the invention the ribs extend continuously all the way along the rod. The rib has no beginning and no end and consequently the rod has no weak locations and there is no wedge action.

The reinforcing rod preferably has four, continuous ribs distributed at equal distances around the periphery of the rod.

The fact that the rod has the same cross section, or a symmetrical cross section, all the way along its length allows the reinforcing rod to take higher static and dynamic loads than the conventional rod. The reinforcing rod also has considerable advantages in manufacture. Due to the fact that the ribs run continuously, they can be rolled out of the core material by a continuous rolling action. This allows the rolling to be performed in a sequence of stages, particularly in the case of rod of large diameter with correspondingly high ribs, each stage requiring a comparatively moderate rolling pressure. The comparatively gentle, repeated deformation of the steel prevents the production of brittleness. A further advantage obtained by conducting the rolling in several stages is that a comparatively easy transition can be obtained between the core and the ribs, minimising notch stresses. The flanks of the ribs can be steeper than has hitherto been possible, resulting in a better anchoring in the concrete and less wedge action.

In one construction the ribs run parallel to each other. In an alternative construction neighbouring ribs are displaced in position longitudinally relative to each other by a half of a serpentine pitch.

The invention also includes apparatus for manufacturing the reinforcing rod or wire having continuous serpentine ribs, the apparatus having several calibrating deformation rolls, the edges of the calibrating surface of each of which deviate from a middle line periodically so that the distance between each edge and the middle line varies periodically between two extreme values.

In this rolling tool the ribs are not formed on the rod by recesses in the calibrating surface of the roll, but on the contrary are formed by continuously squeezing the material of the rod out into the spaces between neighbouring rolls. The edges of the calibrating surface on the roll run parallel to each other, producing on the rod parallel serpentine ribs extending generally axially along the rod. Alternatively these edges can be spaced apart at distances which vary periodically along the rod, between a maximum and a minimum distance. In this case the rod is given serpentine ribs displaced in position longitudinally.

The flanks of each roll have slopes which preferably vary periodically between a maximum and a minimum slope so that each rib has itself a constant flank slope, and so that the rolls in the set of rolls do not interfere with each other. The maxima and minima of the two flank slopes on each roll preferably coincide with the distances between the edges of the calibrating surfaces, and the maxima and minima of these distances coincide with the slope angles.

Each roll has a calibrating surface which varies in width around the periphery of the roll, the flanks of the roll, that is to say the side surfaces intersecting the calibrating surface, varying in slope correspondingly, the flank breadth also varying correspondingly.

The roll assembly preferably consists of four individual rolls set at 90° to each other. The calibration surface width of each roll, which varies periodically between two extreme values, can be displaced in position by a half of a serpentine pitch relative to the calibrating surface of each neighbouring roll. A half of serpentine pitch is the distance between two extreme calibrating surface widths. The rib produced on the rod is therefore a continuous serpentine extending generally axial with respect to the rod, neighbouring ribs being displaced in position, longitudinally along the rod, by one half of a serpentine pitch. The height of the rib depends on the roll pressure. The width of the rib is determined by the distance between neighbouring rolls. The rolling apparatus allows ribs to be squeezed continuously out of the rod without any irregularities being produced on the rib. The rod, if of standard diameter, is rolled in a single operation, directly from the initial round rod material to the final ribbed product. In the case of rod of large diameter it can however be desirable to roll the rod in two passes by using two sets of rolls in sequence, a preliminary pass roll and a final pass roll.

The calibrating surfaces of the rolls may be located around a common circle. A particular advantage of the invention is that during the rolling the entire calibrating surface of each roll is available for applying the rolling pressure. Consequently less rolling pressure is required, compared to the known rolling devices, with correspondingly less wear on the rolls, so that the rolls have a longer working life.

Some examples of reinforcing rod and a rolling apparatus for their production are illustrated in the accompanying drawings, in which:

FIG. 1 is a side view of a length of a rod;

FIG. 2 is a cross section taken on the line II — II in FIG. 1;

FIG. 3 is a development of the peripheral surface of the reinforcing rod of FIG. 1;

FIG. 4 is a development of the peripheral surface of another version of the reinforcing rod, in which the ribs are displaced longitudinally relative to each other by one half of the pitch of the serpentine;

FIG. 10 is a plan of a part of the roll assembly during the rolling operation, one pair of rolls being omitted;

Figure 5:
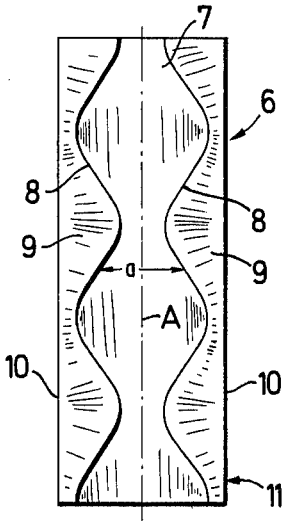
FIG. 5 is a front view of a part of a deformation roll.

The illustrated reinforcing rod 1 for reinforcing concrete, has a circular core 2 from which there project ribs 3 distributed around the periphery of the core. Each rib 3 follows a regular serpentine path (curved zig-zag or pseudo sinusoidal) generally axially with respect to the rod. As shown in FIG. 3, the ribs run parallel to each other, that is to say at any given cross section of the rod all the ribs have the same pitch angle and run in the same direction. Each rib 3 is preferably trapezoidal in cross section and has flanks 5 which slope at an angle preferably greater than 45° with respect to the peripheral surface of the core.

In the illustrated example there are four ribs equally spaced around the periphery of the core, whose cross sectional area is the same at all cross sections along the length of the rod. In an alternative version, represented in FIG. 4, the serpentine ribs 4 are staggered in position longitudinally by a half pitch of the serpentine, the greatest distance between neighbouring ribs being one half of the pitch.

Figure 6:
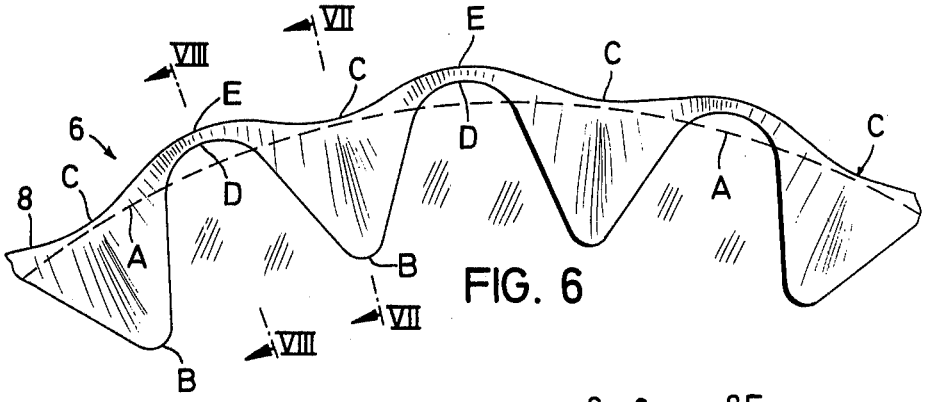
FIG. 6 is a side view of a part of the roll shown in FIG. 5.
Figure 8:
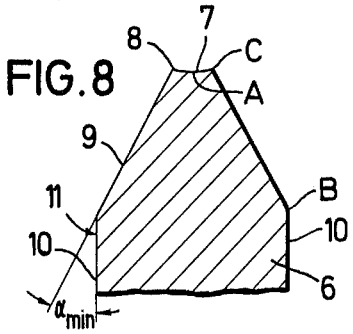
FIG. 8 is a corresponding section taken along the line VIII — VIII in FIG. 6.
Figure 7:
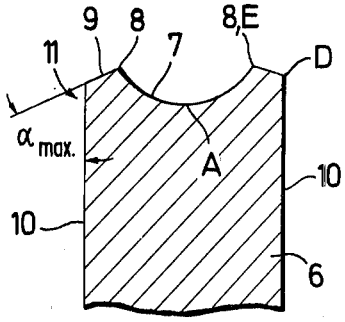
FIG. 7 is a section through a part of the roll, taken on the line VII — VII in FIG. 6.

A roll 6 for rolling the rod has a calibrating surface whose width $a$, measured between the edges 8 of the calibrating surface varies continuously between a maximum (FIG. 7) and a minimum (FIG. 8). FIG. 5 shows the serpentine shapes of the edges 8 of the calibrating surface. FIG. 6, which is a side view of a part of the roll, shows several points, A,B,C,D,E, which are also shown in FIGS. 7 and 8. At point E the edges 8 of the calibrating surface 7 are spaced apart at the maximum distance $a$. At this location the flanks 9 have the greatest slope $\alpha$ (between point E and point D). On the other hand at the point C the calibrating surface widths $a$ reaches a minimum (point C). At this location the slope $\alpha$ of the flanks 9 is also a minimum (between points C and B). The slope angle $\alpha$ of the flanks 9 is the angle which the flank makes with the flat cheek 11 of the roll. It will be observed that with the continuous, periodic variation of the calibrating surface width $a$ the flank slope $\alpha$ varies between its maximum and minimum values, with corresponding variations in the depth of the flank 9, the radial height of the calibrating surface edge 8 above the central point A of the calibrating surface 7 also varying (between points E and C) as shown in FIGS. 6, 7 and 8.

Figure 9:
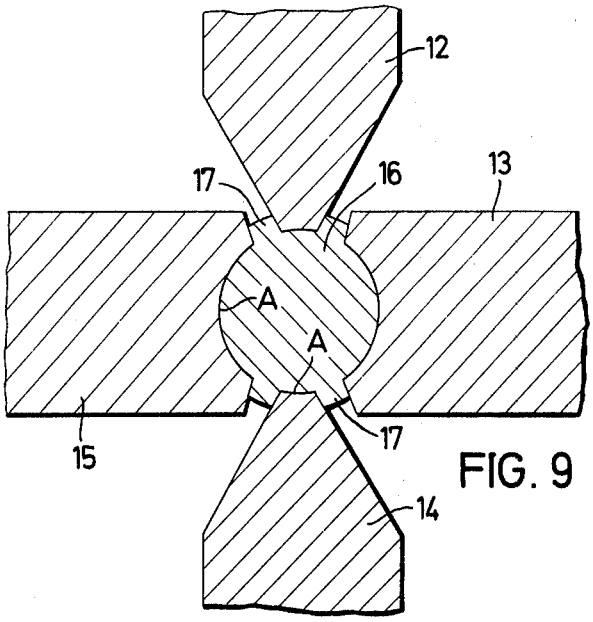
FIG. 9 is a cross section showing a roll assembly.

FIG. 9 shows a preferred version of the calibrating roll assembly, consisting of four rolls 12, 13, 14, 15, forming a closed pass for rolling a reinforcing rod which is shown in cross section at 16. The rolls are arranged as two opposite pairs 12, 14 and 13, 15, with a 90° angle between the two pairs. In FIG. 9 the pair of rolls 12, 14 are producing the least calibrating surface width $a$, whereas the pair of rolls 13, 15 are producing the greatest calibrating surface width $a$. Between neighbouring rolls the serpentine ribs 17 are squeezed out, there being as many ribs as there are rolls.

FIG. 10 illustrates the rolling process, using the set of calibrating rolls represented in FIG. 9. The rolls can if desired be driven individually. FIG. 10, which is a plan view, shows only the opposite, horizontally acting rolls 13 and 15. The vertically acting rolls 12 and 14 have been omitted, for the sake of greater clarity. The hot reinforcing rod has an initial diameter $d_1$ and is first attacked by the rolls at the location F. At this location the distance between the calibrating surfaces of the two rolls is equal to the initial rod diameter $d_1$, so that the rolls begin to deform the rod. The calibrating surfaces of the two rolls 13, 15 come closest together at the location G, whereupon the rolling process is terminated. During the rolling the diameter of the rod, at the calibration surface, has been reduced from $d_1$ to $d_2$. The rolled rod has four continuous serpentine ribs distributed around its periphery, the serpentines of neighbouring ribs being displaced in position longitudinally by one half of a serpentine cycle. In each serpentine cycle the distance between neighbouring ribs varies between its two extreme values.

Figure 11:
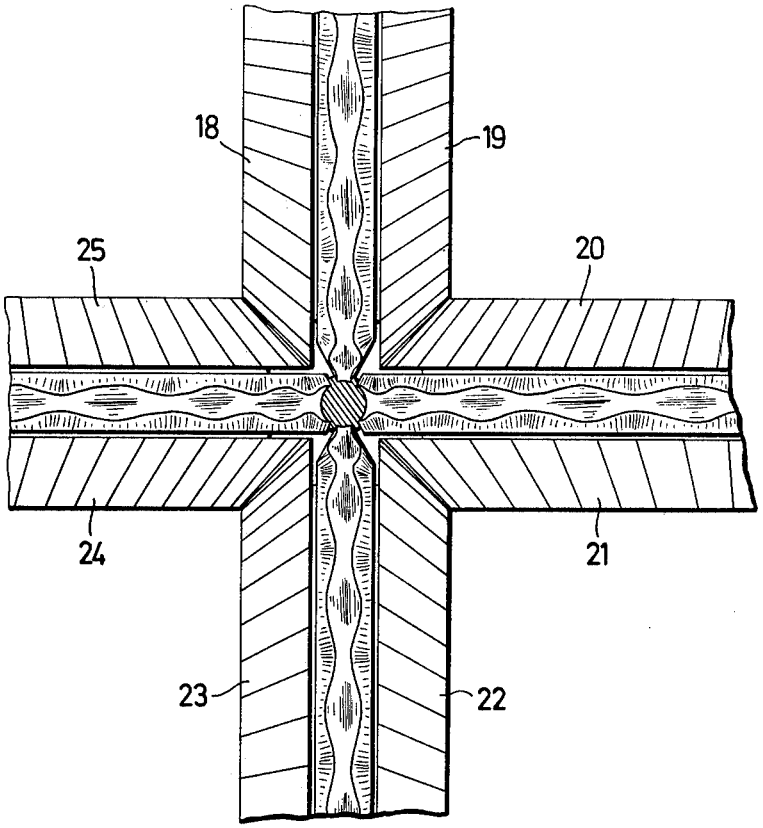
FIG. 11 is a cross section corresponding essentially to FIG. 9, but showing a bevel gearwheel fixed to each cheek of each roll; and, FIG. 12 shows bevel teeth cut into the flanks of each roll.

In order to ensure that the four rolls 12, 13, 14, 15 rotate synchronously, eight bevel gearwheels 18, 19, 20, 21, 22, 23, 24, 25 can be used, one gearwheel fixed to each cheek of each roll, neighbouring gearwheels, for example 19, 20 and 25, 18, meshing together, as shown in FIG. 11. Alternatively if desired bevel teeth can be cut into the flanks 9 of the rolls, as shown in FIG. 12 at 27, 28, 29, 30, 31, 32, 33 and 26.

I claim:

1. Apparatus for rolling a rod into a reinforcing rod for concrete and for forming laterally spaced cold rolled serpentine ribs on the outer surface of the rod which ribs extend generally in the axial direction of the rod, comprising a plurality of rolls each mounted for rotation about an axis and each said roll having a calibrating surface formed on and extending around the outer circumference thereof and said calibrating surface arranged to contact the outer surface of the rod, said rolls positioned angularly apart forming a pass therebetween for the rod with the calibrating surfaces of said rolls defining the pass, each said calibrating surface having a pair of spaced circumferentially extending edges along each of the opposite sides of the calibrating surface, each said roll having a pair of cheeks extending transversely of the axis of said roll and a flank extending between each said cheek and the adjacent edge of said calibrating surface, said flanks extending outwardly from the pass formed by said rolls and adjacent said flanks on the adjacent surfaces of said rolls being disposed in spaced relation forming an open gap between adjacent rolls extending outwardly from said pass wherein the ribs are formed on the rod, said calibrating surface on each said roll having a circumferential center line spaced equidistantly from its edges and the edges of said calibrating surface having a continuously varying dimension from said circumferential center line alternating periodically in a regular repetitive manner between a maximum and a minimum spacing.

2. Apparatus according to claim 1, in which the edges run parallel to each other.

3. Apparatus according to claim 1, in which the flank on each roll cheek forms a slope $\alpha$ with said roll cheek which varies periodically between a maximum and a mimimum value.

4. Apparatus according to claim 3, in which the slopes $\alpha$ of the two flanks of each roll have maxima and minima which coincide.

5. Apparatus according to claim 4, in which the maxima and minima of the slope angles $\alpha$ coincide with the maxima and minima of the distance between the calibrating surface edges.

6. Apparatus according to claim 1, which has four rolls set at 90° to each other, the rolls having calibrating surfaces whose widths vary periodically between two extreme values, the widths of the calibrating surfaces of neighbouring rolls being staggered in position by one half of the pitch of the edges of the calibrating surfaces.

7. Apparatus according to claim 6, in which the calibrating surfaces of the rolls have a common calibrating circle.

8. Apparatus according to claim 1, in which a bevel gear wheel is mounted on each of said cheeks of each said roll and has teeth which mesh with those on adjacent cheeks of adjacent rolls so that the rolls are constrained to rotate synchronously.

* * * * *